United States Patent [19]

Gagnebin

[11] 3,978,967

[45] Sept. 7, 1976

[54] TYPEWRITER TABULATOR

[75] Inventor: Gustave Gagnebin, Yverdon, Switzerland

[73] Assignee: Hermes Precisa International S.A., Yverdon, Switzerland

[22] Filed: Sept. 16, 1974

[21] Appl. No.: 506,583

[30] Foreign Application Priority Data

Sept. 17, 1973 Switzerland ..... 13285/73

[52] U.S. Cl. ..... 197/177

[51] Int. Cl.[2] ..... B41J 21/14

[58] Field of Search ..... 197/176, 177, 178, 179, 197/183

[56] References Cited

UNITED STATES PATENTS

| | | | |
|---|---|---|---|
| 941,166 | 11/1909 | McLaughlin | 197/179 |
| 974,438 | 11/1910 | Schaaf | 197/177 |
| 994,209 | 6/1911 | Steiger | 197/177 |
| 1,264,292 | 4/1918 | Gorin | 197/176 |
| 1,356,926 | 10/1920 | Kurowski | 197/177 |
| 1,892,071 | 12/1932 | Myers et al. | 197/178 |
| 3,777,870 | 12/1973 | Drogi | 197/176 |

*Primary Examiner*—Anton O. Oechsle
*Attorney, Agent, or Firm*—Emory L. Groff, Jr.

[57] ABSTRACT

The tabulator blade rack consists of a pivotally and axially movable rod. Depressing the desired decimal tabulation key frees the carriage from the escapement for movement in the typing direction, raises the corresponding tabulator stop, and rotates the tabulator rack and the blades thereon. Operation of the set and clear key sets a blade; the carriage moves, striking a projection on the set blade, thereby shifting the rack to the right until a stop thereon hits the raised tabulator stop, stopping the carriage at the corresponding position. When the rack stop hits the tabulator stop, the consequent movement of a rod that mounts the latter causes the raised tabulator stop to be lowered, the return of the rack, both longitudinally and rotationally, to its rest position, and the carriage to be reengaged with the escapement at the chosen tabulating position.

11 Claims, 10 Drawing Figures

VII
VII
1
7
12
21
22
23
24
25
26
27
28
29
30
10
11
43
46
47
48
50
51
52
53
54
A
B
O
T

TYPEWRITER TABULATOR

The invention relates to a tabulator for typewriters having a carriage carrying a type head, or type element, and movable along a platen. Known tabulators incorporate a rack carrying a series of tabulator blades that are individually movable, under control of the typist, between inactive and set positions, the carriage having a stop that cooperates with a blade in the set position.

An object of the invention is a decimal tabulator that is simpler in construction, dependable, and inexpensive to manufacture, which tabulator is in such wise adaptable to typewriters using a type head as to require the mounting of only a minimum number of parts on the carriage.

In accordance with the invention, this object is attained by constructing the tabulator rack in the form of a rod that carries the blades. Means are provided for mounting the tabulator rod free to pivot about its axis and to move therealong from a rest position. Means are also provided for pivoting the tabulator rod under control of the typist to a number of different angular positions for tabulation, the pivoting of the rod moving the blades into a series of different angular positions from a rest position. Each blade comprises first and second areas; and the carriage comprises first and second fixed stops that move with the carriage and are so located thereon, with respect to the first and second areas, that, when the carriage is stationary in a determined position for setting the tabulator, they face and cooperate with respective ones of the first and second areas of a blade for setting and subsequently clearing the latter during pivoting of the tabulator rod. The second areas are so located on the blades that a second area is placed in the path of the carriage stop when its blade is rotated to the set position, so that when setting the tabulator the carriage stop of the moving carriage hits the second area of the set blade and causes the tabulator rod to move along its axis with the carriage. Finally, there are provided selector means under control of the typist for limiting the axial movement of the tabulator rod and consequently of the carriage so that the latter is stopped for typing at the chosen tabulating position.

The invention will be described with reference to the Figures of the drawings, wherein:

FIGS. 1*a* and 1*b* are side views, partly in section, of the tabulator.

Figure 5B:
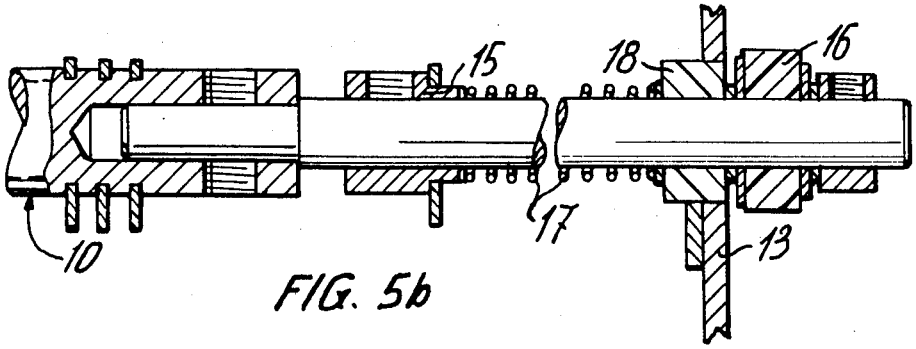
Figure 5A:
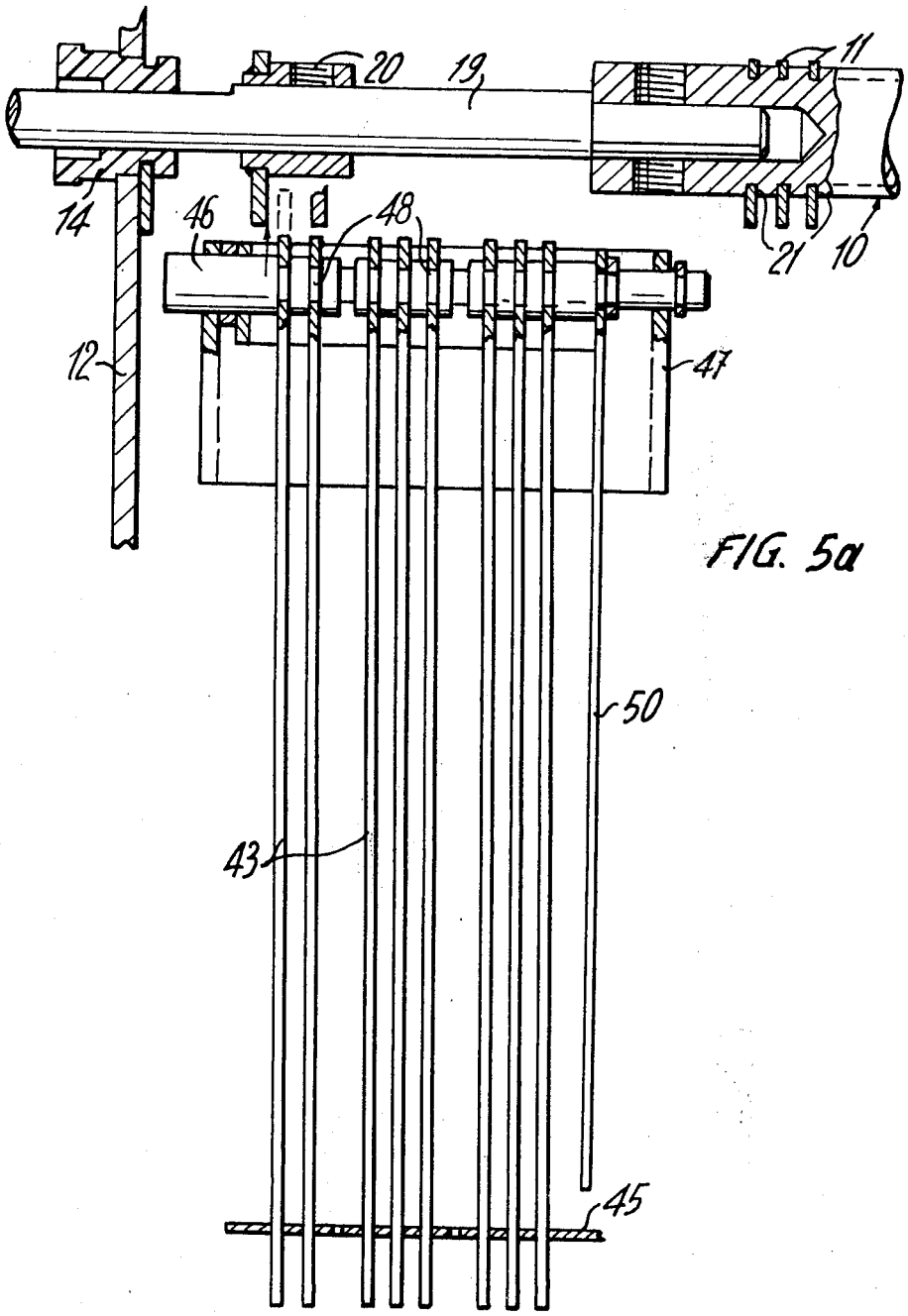

FIGS. 5*a* and 5*b* are longitudinal views, partly in section, of the two ends of the rack.

Figures 4, 6:
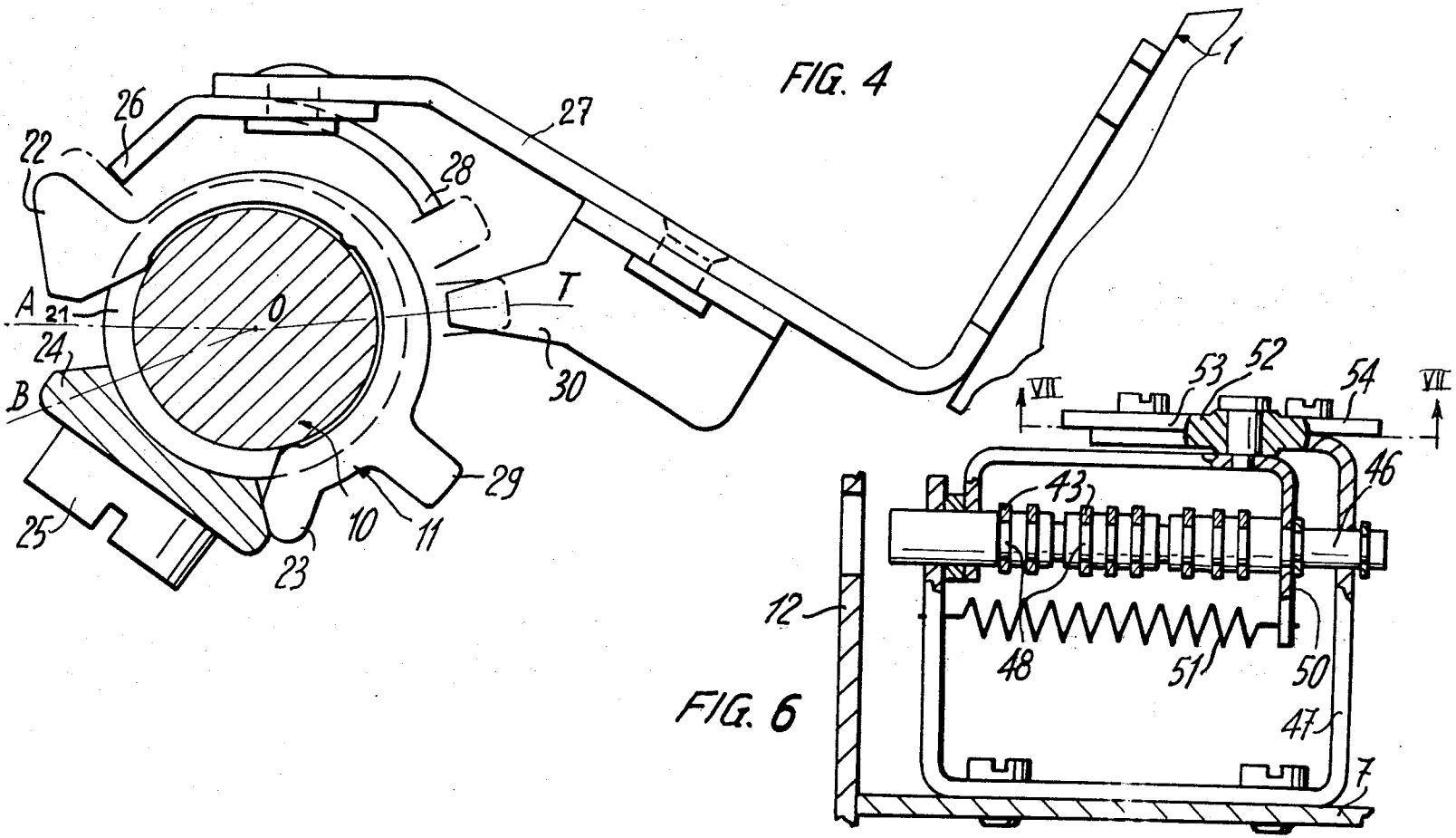
FIG. 4 is a sectional view, on expanded scale, of the tabulator rack shown in the upper left hand corner of FIG. 1*a*.

FIG. 6 is a plan view, partly cut away, of part of the mechanism shown in FIG. 5*a*.

Figure 7:
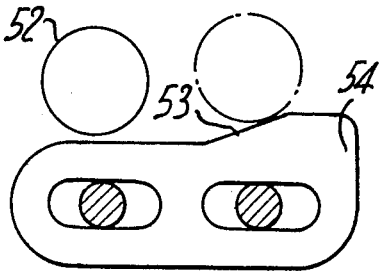

FIG. 7 is a schematic view taken along line VII—VII of FIG. 6; and

Figure 8:
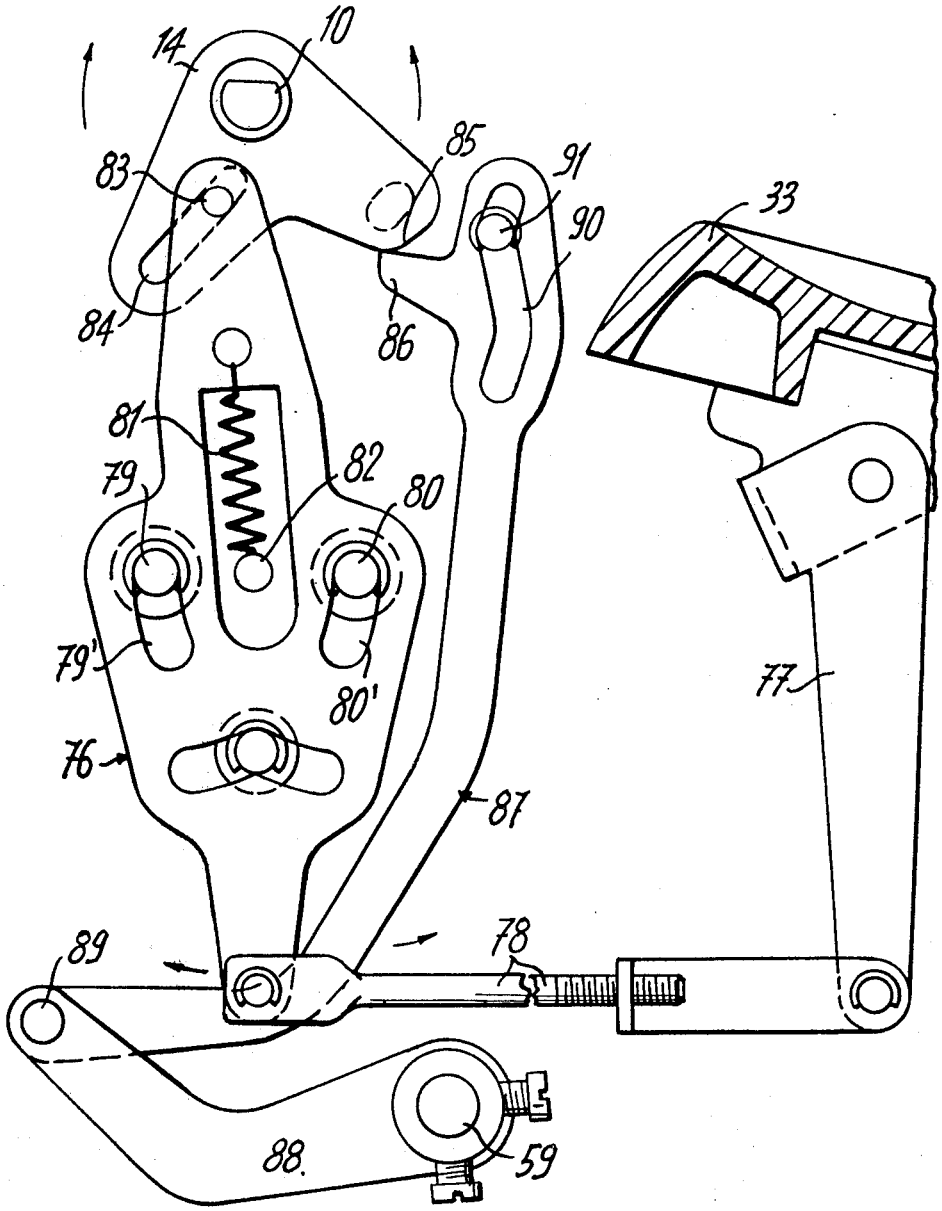

FIG. 8 is a side view of part of the tabulator.

The typewriter shown in the drawings comprises a carriage designated generally by the reference numeral 1 (FIG. 1*a*) and carrying a type head, or type element, not shown, which is free to slide along a rotatable control and guide shaft 2. This sliding movement of the type head is parallel to the platen 3. The escapement controlling the movements of the carriage 1 incorporates a pawl 4 pivotally mounted at 8 on the base 5 of the carriage 1. The pawl cooperates with a rack 6 that extends the entire width of the typewriter and is fixed to the frame 7 of the latter. The escapement is controlled by a universal bar 9 that is free to cooperate with the pawl 4. A control arrangement, not shown, operates the bar 9.

The tabulator of the typewriter comprises a tabulator rack designated generally by the reference numeral 10 and consisting of a tabulator rod carrying a series of spaced tab blades 11. The rod extends over the entire width of the typewriter at the upper part thereof. The rack 10 is supported at each end by the respective left and right side walls 12 and 13 (FIGS. 5*a* and 5*b*) that are fixed to the typewriter frame. The rack is free both to rotate about its own axis and to move longitudinally. The rack is rotated by means of a control lever 14 (FIGS. 5*a* and 8) fixed to the left hand part of the rack. The maximum longitudinal movement of the rack is limited by an end stop 15 (FIG. 5*b*) and by a rubber stop 16 fixed to the right end of the rack. The rack is moved longitudinally against the force of a compression spring 17 positioned on the right hand part of the rack, between the end stop 15 and a synthetic plastic bearing 18 that is fixed to the side wall 13. On the rest position, the stop 16 bears against the wall 13. The rack rod 10 incorporates at its left end (FIG. 5*a*) an extension 19, which is of sufficient length to enable the rack to move longitudinally. To the extension 19 is fixed a decimal tabulator stop 20, which cooperates with a selection arrangement, hereinafter called the selector, that fixes the extent of the longitudinal movement of the tabulator rack 10.

The selector (FIG. 5*a*) is mounted under the rack 10 at the extreme left hand side of the typewriter. It comprises eight decimal tabulator stops 43 that are controlled by selector rods 44 (FIG. 1*a*), which latter are operated by eight decimal tabulator keys 32 (FIG. 1*b*) of the typewriter keyboard. The stops 43 are arranged vertically and are mutually parallel, being guided at their lower ends by a stationary support consisting of a guide comb 45 (FIG. 1*a*) fixed to the frame 7, and at their upper ends by a movable support consisting of a longitudinally movable rod 46.

The stops 43 correspond to the usual tabulator keys TD 10 to 10000. The stop 43' (FIGS. 2 and 3) corresponds to a key TD 1, or "tabulator," not shown.

The rod 46 is supported at its ends by a support 47 fixed to the frame 7 (FIG. 6). The guiding of the stops 43 by the rod 46 is done by means of annular grooves 48 incorporated in the rod 46 (FIG. 5*a*), these grooves being engaged by slots 49 in the upper ends of the stops. In this way, each stop 43 is free to slide upwards to cooperate with the tabulator stop 20.

The rod 46 can move longitudinally, and carries a tabulation locking and unlocking lever 50, which moves with the rod 46. The rod 46 and the lever 50 are under the force of a return spring 51 (FIG. 6), which is fixed at one end to the support 47. The horizontal part of the lever 50 carries a small wheel 52 that can be moved along an inclined face, or ramp 53 of an adjusting plate 54 fixed on an edge of the support 47.

As is best seen in FIG. 4, the tabulator blades 11 have the shape of circlets mounted in annular grooves 21 of the rack 10. Each blade 11 incorporates at its ends a respective finger, or projection, 22 or 23, which acts as a stop. A longitudinally shaped member 24, serving as a stop, is mounted on the rack 10 by screws 25, so that the blades 11 are free to occupy two angular positions as determined by the fingers 22 and 23 coming to rest against the respective faces of the member 24. The finger 22 of each blade 11 also cooperates with a nose, or stop, 26 for setting the blades, the nose being fixed to an angled support 27, which is mounted on the upper part of the carriage 1. The support also carries another nose, or stop, 28 for clearing the blades 11, this nose cooperating with another finger, or projection, 29 of each blade 11. The support 27 also incorporates a blade stop 30, which cooperates with the fingers 29. The stops 26, 28, 30 comprise a unit, which can be constructed as a one-piece member fixed to the carriage 1.

The row of eight decimal tabulator keys 32 is arranged in the usual manner at the upper part of the keyboard, which latter includes the customary type keys 31 and also a key 33, shown in FIG. 8, for setting and clearing the blades.

Figure 1A:
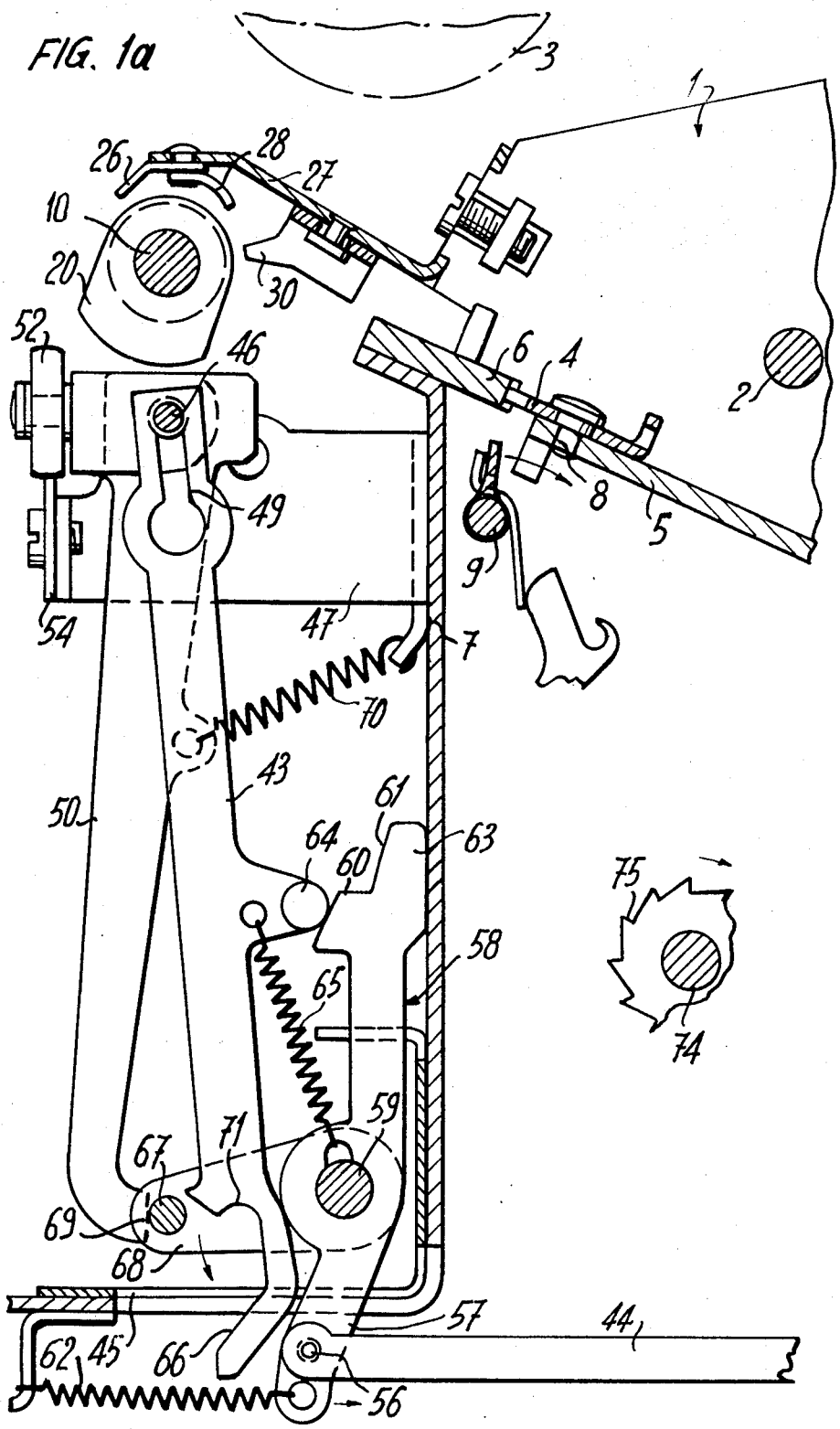
Figure 1B:
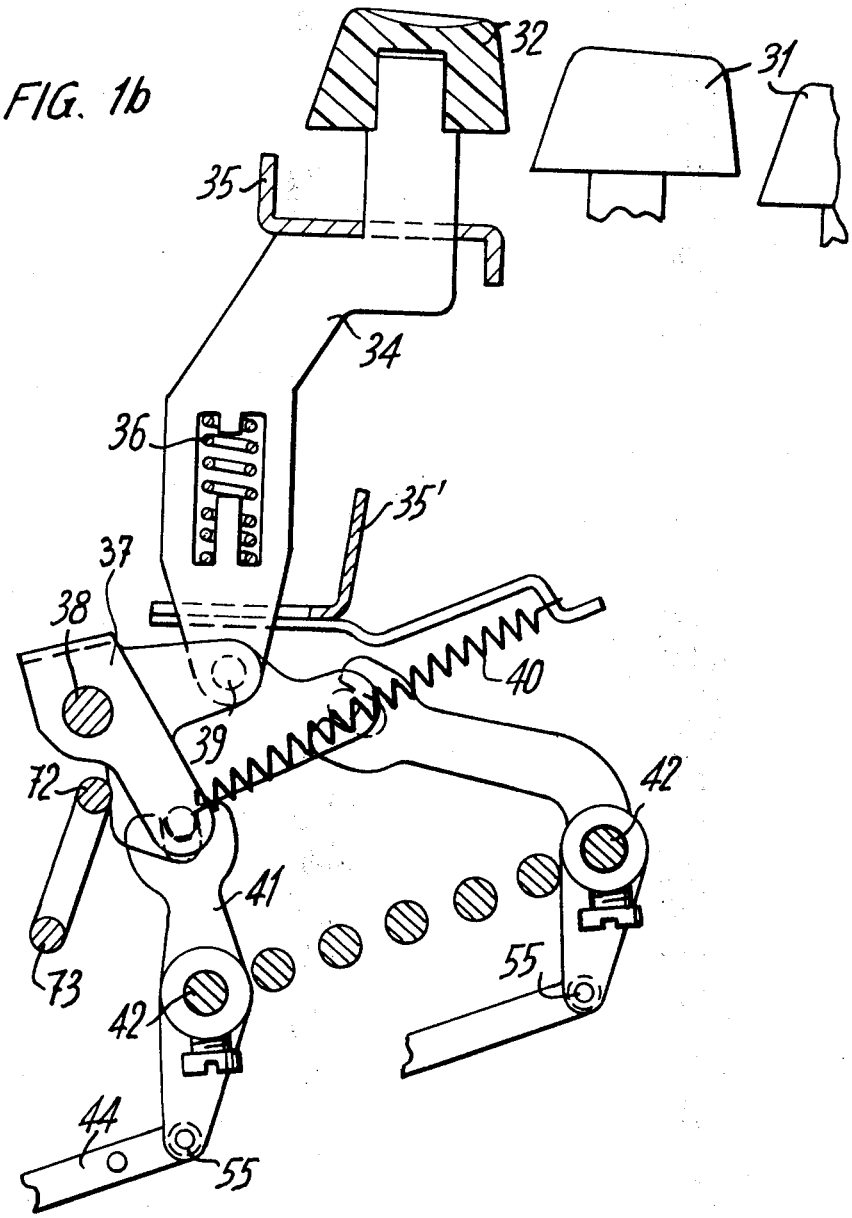
Figure 2:
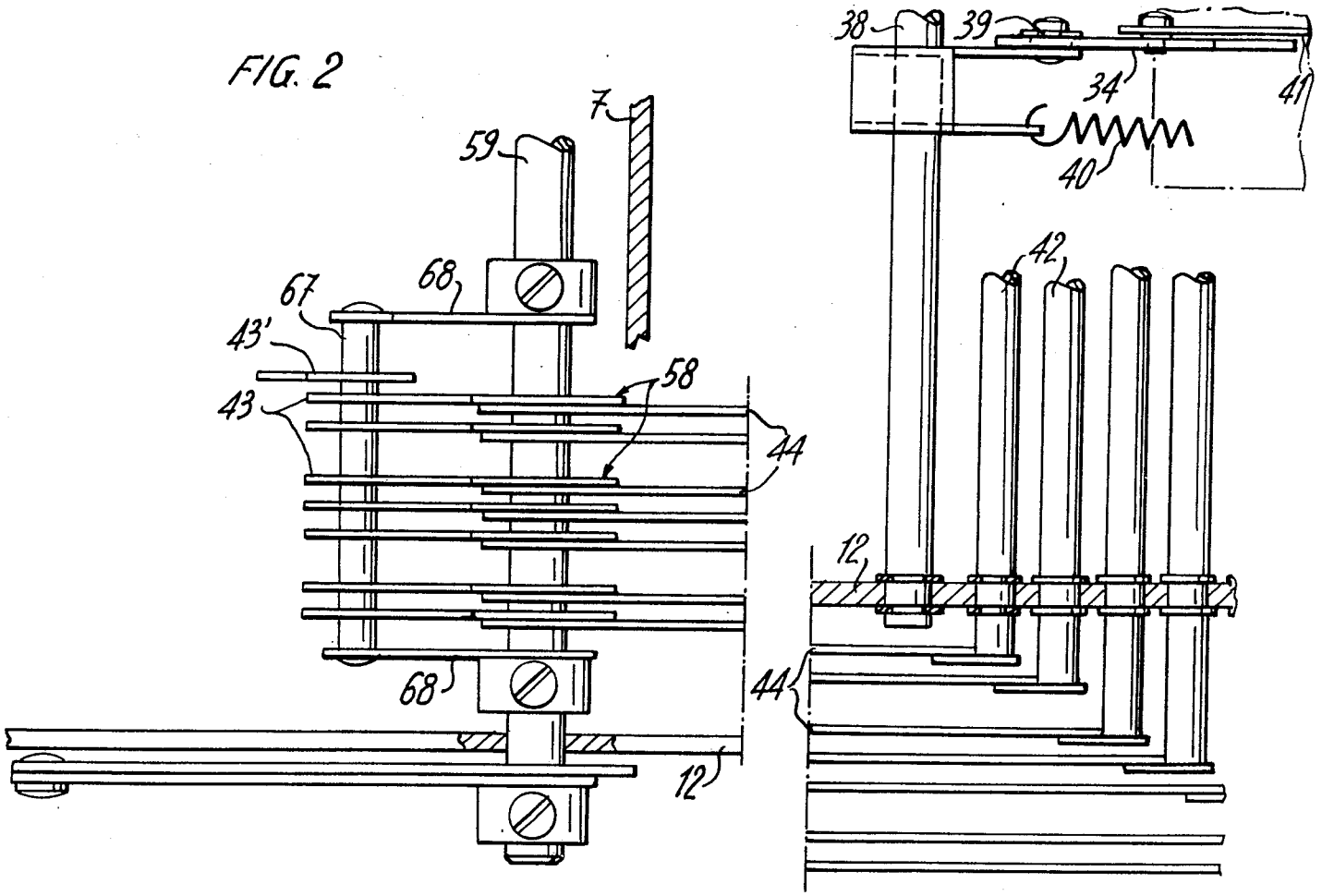
FIG. 2 is a plan view of part of the tabulator shown in FIGS. 1*a* and 1*b*.
Figure 3:
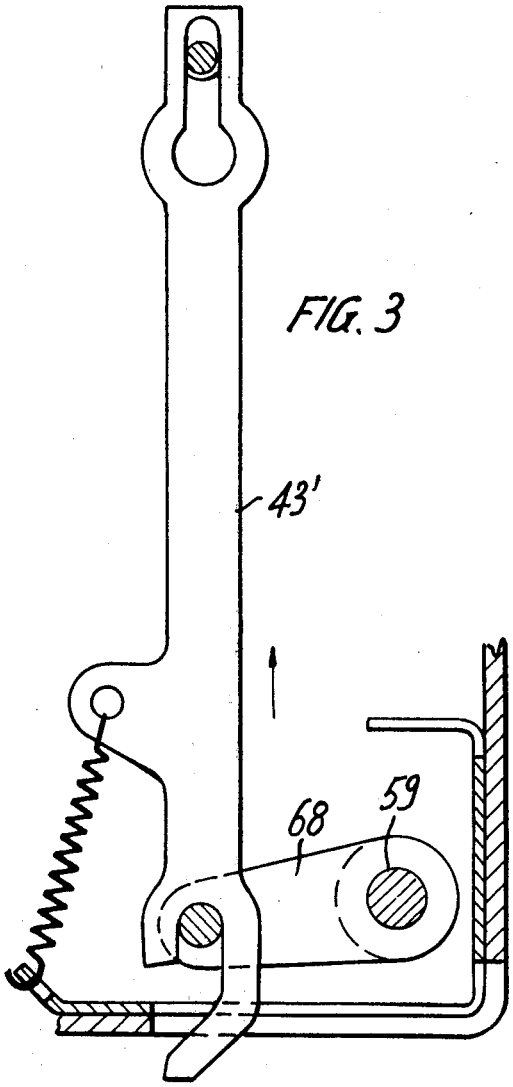
FIG. 3 is a side view showing a detail from FIG. 2.

As shown in FIG. 1*b*, each of the decimal tabulator keys 32 is carried by a key lever 34, which is guided in its movements by guide combs 35 and 35'. Each key lever is free to move vertically, moving with it an angled member 37 that pivots about a transversal rod 38 against the force of a return spring 40. The lower end of the key lever 34 is pivotally connected at 39 to one of the arms of the member 37. One end of the return spring 40 is fixed to the other arm of the member 37 and the other end to a stationary member of the frame. A compression spring 36 determines the second position of the movement of the tabulator keys 32 for repeating an operation. The member 37 transmits its movement to an arm 41 that is fixed to a control bar 42 corresponding to the decimal key operated. FIGS. 1*b* and 2 show the group of control bars 42 corresponding to the different decimal tabulator keys 32. These bars 42 are arranged horizontally and mutually parallel, and are pivotally mounted in the side walls 12 and 13 of the typewriter.

The bars 42 are connected to the selector rods 44 by the arms 41, which are pivotally connected to one end of the rods 44. The other ends of the latter are pivotally connected at 56 (FIG. 1*a*) to the lower arms 57 of control levers 58 for the tabulator stops 43. The levers 58 are pivotally mounted on a shaft 59 that itself is pivotally mounted in the side walls 12 and 13.

Each lever 58 forms in its upper part a dog 63 incorporating a projection 60 and an inclined face 61. Each lever 58 can pivot against the force of a return spring 62, which is fixed at one end to arm 57 and at the other end to the typewriter frame. In position of rest, the spring 62 pushes the head of the dog 63 against the vertical frame wall 7.

Likewise, in a position of rest, a return spring 65 pushes a projection 64 of each tabulator stop 43 against the projection 60 of a respective control lever 58.

A universal bar 67 is rigidly connected to the shaft 59 by two parallel arms 68 (FIGS. 1*a*, 2 and 3) fixed to the shaft. The universal bar 67 is subject to the action of a locking nose constituted by the end 69 of the locking and unlocking lever 50, which a return spring 70, fixed to the support 47, urges in a counter clockwise sense (FIG. 1*a*). The universal bar 67 can be engaged in an indentation 71 incorporated in the lower part of each stop 43.

The tabulator shaft 59 is operated by a control mechanism that will not be described in detail, as it is well known in the art. This control mechanism is released by a universal bar 72 (FIG. 1*b*) that pivots about a rod 73. A return spring, not shown, resiliently presses the bar 72 against the vertical part of the member 37. When the aforesaid control mechanism is released, it meshes with a pinion 75 (FIG. 1*a*) carried by the typewriter operating shaft 74, which is driven continuously in rotation.

By means of an arrangement of levers, not shown, the control mechanism can also operate the universal bar 9 that controls the escapement of the carriage 1.

The tabulator further includes an arrangement for setting and clearing the tabulator blades and for rotating the rack 10 during tabulation to four different positions. This arrangement will be described with reference to FIG. 8. The setting and clearing of the blades is controlled by the key 33, which operates a rocker 76 by means of a lever 77 that is pivotally connected to a connecting rod 78. This rocker is free to pivot in turn about one of the pins 79 or 80, respectively corresponding to setting and clearing the blades 11, these pins being free to move in the openings 79' and 80' that are located symmetrically with respect to the axis of the rocker. The pivotal movements of the rocker 76 are made against the force of a return spring 81 connected at one end to a stationary member 82 of the typewriter.

A pin 83, which is fixed in the upper end of the rocker 76, engages an opening 84 incorporated in the control lever 14 for rotating the rack 10. As shown in FIG. 8, the lever 14 has two arms, one of which has the opening 84, and the other of which presses at its end 85 against a nose 86 of an angled lever 87 for clearing the blades 11 and for controlling the tabulation. The lever 87 is pivotally connected at 89 to a control lever 88, which is fixed to the shaft 59. The lever 87 is guided in its movement by an opening 90 that is engaged by a stationary pin 91.

It will now be seen that the tab blades can be moved to four angular positions by rotating the rack 10 in one direction or the other. Position 1 is the position of rest, wherein fingers 22 and 29 are shown in solid lines in FIG. 4. This is the position before and after the tabulation, and is obtained by positioning of lever 14 in the position shown in FIG. 8 by the pin 83 in slot 84, the parts being urged to that position by spring 81. Position 2 is the position in which finger 22 is held between stops 24 and 26. This position is reached by pressing key 33, FIG. 8, on its left hand end to move rod 78 to the right, which will turn rack 10 clockwise through linkage 76, 14. Note that the tab blades 11 are frictionally and slidably connected to the rack 10. Position 3 is obtained by pressing key 33 on the right hand end, FIG. 8, to rotate the rack 10 in the opposite direction, in which finger 29 abuts stop 28, and stop 24 abuts finger 23. Position 4 is the tabulation position, in which finger 29 is in line with stop 30. This position is accomplished by upward movement of lever 87 to a position determined by the position of shaft 59 in the tabulation operation.

The tabulator described operates in the following manner.

Operation of key 33, FIG. 8, sets the blades to begin the tabulation operation. When one of the tabulator keys 32 is depressed, the key lever 34 transmits the movement to the angled lever member 37, rotating it clockwise, FIG. 1*b*. This rotation moves the universal bar 72 counterclockwise about its pivot 73, and also moves the pivoted arm 41 counterclockwise. The movement of the universal bar 72 is arranged, by means, not shown, to rotate shaft 59 clockwise, and to rotate the universal bar 9 clockwise to disengage the escapement pawl 4 from the spacing rack 6, thus freeing the carriage to move to its left hand rest position with reference to FIGS. 5*a* and 5*b*. It is considered that the means for accomplishing the movement of shaft 59 and bar 9 is within the mechanical skill of a typewriter mechanic.

Movement of the pivoted arm 41 counterclockwise pulls rod 44 to the right, FIGS. 1*a* and 1*b*, rotating control lever 58 counterclockwise. Due to the camming action of projection 60, the projection 64 on the selected tabulator stop 43 is moved upwardly and to the left, FIG. 1*a*. Since shaft 59 is simultaneously being turned clockwise, as explained above, the universal bar 67 is moved upwardly by arm 68, secured to shaft 59. This will result in bar 67 engaging indentation 71 on stop 43 to assist in raising stop 43, and also will move bar 67 above the locking nose 69. The spring 70 will then move the locking and unlocking lever 50 counterclockwise, FIG. 1*a*, thus latching arm 68 above nose 69. This will slide the stop 43 upwardly along its guide 46 into a position to be engaged by the tabulator stop 20 to position the carriage and type head at the desired space.

The shaft 59 has connected thereto a control arm 88 connected at 89 to the lever 87, FIGS. 8 and 2. The turning of shaft 59 as explained above, moves the arm 88, lever 87 with its nose 86, upwardly and turns rack 10 and tab blade 11 from the rest position shown in solid line in FIG. 4, to the tabulation position O-T. It will be noted that the tab blades 11 frictionally and slidably engage rack 10. The mechanism will be locked in this position by the engagement of nose 69 beneath bar 67. The key 32 will return to the position shown in FIG. 1*b*, under the influence of springs 40 and 62. Lever 58 will return to the position shown in FIG. 1*a*.

At this point the carriage shifting mechanism will shift the carriage to the right, with reference to FIGS. 5*a* and 5*b* until the blade stop 30 strikes the blade 11 that has been set in tabular position. Since blade 11 is mounted on rack 10, this carriage movement will cause the rack 10 to move to the right, FIGS. 5*a* and 5*b*, against the force of spring 17 until stop 20, carried by the rack, strikes the raised tabulator stop 43. This will cause the carriage to stop at the position selected by the selector key 32.

It should be remarked that the amount of longitudinal movement of the rack 10 is determined by the stop 20 striking one of the eight tabulator stops 43, whereby the carriage 1 is stopped at one of the eight decimal positions.

When the stop 20 strikes one of the stops 43, the latter unlocks the tabulation by means of the wheel 52, which moves along the unlocking ramp 53 to the position shown in dot-dash line in FIG. 7, because the horizontal part of lever 50 carrying wheel 52 moves slightly to the right (FIG. 6) against the force of the spring 51 causing lever 50 to move to the left, FIG. 1*a*, against spring 70 to free bar 67. This will allow stop 43 to disengage from bar 67 and be moved downwardly and to the right, FIG. 1*a*, out of the path of stop 20. It will also allow shaft 59 and arm 68 to rotate counterclockwise, rotating arm 88, FIG. 8, counterclockwise to lower angled member 87 so that nose 86 no longer engages lever member 14. The unlocking of the tabulation causes the shaft 59 to return to its rest position, the control mechanism being disengaged from the pinion 75. The escapement pawl 4 again engages a tooth of the rack 6, so that the carriage 1 is stopped at the decimal position as determined by the blade 11. Moreover, the unlocking also rotates the rack 10, which returns to its rest position determined by the rest position of pin 83, FIG. 8. In addition, the raised stop 43, as well as the stop 43'if used, lower to their rest positions. Finally, the rack 10 moves longitudinally leftwards and returns to its rest position, under the force of the compression spring 17, the stop 16 again coming to rest against the wall 13 (FIG. 5*b*).

It should be noted that raising one of the eight stops 43, by means of the control mechanism, fixes one of the eight longitudinal positions of the rack 10 corresponding to seven or nine spacing steps.

It is also worth noting that the longitudinal travel of the rack 10 can be varied according as to whether the stops 43 are mounted close together or farther apart. When spaced farther apart, the stops enable a spaced decimal tabulation that comprises a gap for typing each number in groups of three figures.

It is likewise worth observing that the spring 36 enables the repetition of an operation when one of the keys 32 is held down to the second position. The projection 64 of the raised stop 43 continues to press against the inclined holding face 61, during the operation "repeat". Spring 36, FIG. 1*b*, is mounted in a groove of lever or arm 34, so that it exerts no action on this arm except when its lower extremity pushes against the teeth of guide comb 35'. Key 32 is kept in its position of rest, illustrated in FIG. 1*b*, by spring 40 which acts on angled lever 37 pivoting in 38. The first position of key 32 is obtained when spring 36 pushes against guide comb 35'. To reach the second position, a greater force must be exerted on key 32 to compress spring 36.

In the described arrangement, the tabulator blade that is responsible for determining where the carriage 1 will be stopped is located ten spacing steps in front of the stop position on the ones' column. Consequently, if the carriage 1 is located ten or more spacing steps from this column, the selected tabulator blade cannot cooperate with the stop 30. Although such conditions are scarcely very likely to occur in practice, this slight inconvenience is easily avoided by providing a mechanism that moves the rack, before or after the rotation of the latter to move the blades into the active position, all the way to the right, Next, the selector rod 44 is operated, and then the rack is freed axially so that the spring 17 pushes it to the left (FIGS. 5*a* and 5*b*). If the carriage is ten or more spacing steps from the stop position on the ones' column for that tabulator blade concerned with the tabulation in hand, this blade strikes the stop 30 of the carriage 1 before the complete movement of the rack 10. The tabulation is now carried out in a normal way, by disengaging the escapement and by the cooperation between the stop 20 of the rack 10 and the raised tabulator stop 43.

In accordance with the invention, means can be provided for tabulating in intervals of two spaces.

Although the invention has been particularly shown and described with reference to the preferred embodiment, those skilled in the art will understand that the invention admits of changes in form and detail, aside from those already described, without exceeding the spirit and scope of the invention.

I claim:

1. A tabulator for typewriters having a carriage carrying a type head and movable along a platen, the tabulator comprising a rack having a series of tabulator blades that are individually movable between an inactive position and a set position, and the carriage comprising a carriage stop for cooperating with a blade in the set position, and wherein the improvement comprises a tabulator rod defining an axis, comprising the rack, and carrying the blades; means for mounting said tabulator rod free to pivot about said axis and to move therealong from a rest position; means for pivoting said tabulator rod under control of the typist to a plurality of distinct angular positions for tabulation, whereby the pivoting of said tabulator rod moves said blades into a plurality of different angular positions from a rest position; first and second areas comprised by each of said blades; first and second fixed stops comprised by said carriage and moving therewith and so located thereon, with respect to said first and second areas, that, when said carriage is stationary in a determined position for setting the tabulator, they face and cooperate with respective ones of said first and second areas of a blade for setting and subsequently clearing the latter during pivoting of said tabulator rod; and wherein said second areas are so located on said blades that a second area is placed in the path of the carriage stop when the blade thereof is rotated to the set position, so that when setting the tabulator said carriage stop of the moving carriage hits said second area of the set blade and causes said tabulator rod to move along said axis with said carriage; and selector means under control of the typist for limiting the axial movement of said tabulator rod and therefore of said carriage so that the latter is stopped for typing at the chosen tabulating position.

2. The tabulator as defined in claim 1, wherein said first and second areas are projections.

3. The tabulator as defined in claim 1, wherein said carriage stop and said first and second fixed stops comprise a unit mounted on said carriage.

4. The tabulator as defined in claim 3, wherein said unit is a one-piece member.

5. The tabulator as defined in claim 1, comprising a tabulation control shaft for pivoting said tabulator rod and controlling said selector means, the carriage escapement, and the pivoting of said tabulator rod.

6. The tabulator as defined in claim 5, further including stop means on said tabulator rod and moving therewith; means for locking and unlocking the tabulation; and wherein said selector means includes a plurality of movable tabulator stops individually movable between a rest position and an active position for so cooperating, in said active position, with said stop means that when said carriage stop hits said second area of a set blade said tabulator rod is moved axially until said stop means thereof strikes the tabulator stop in said active position; connecting means for enabling each tabulator key to cooperate with a respective tabulator stop for causing the latter to be moved to said active position when the corresponding tabulator key is operated; and means for moving the respective tabulator stop to said active position when the corresponding tabulator key is operated.

7. The tabulator as defined in claim 6, wherein said means for locking and unlocking the tabulation is so mounted with respect to said tabulator rod that the axial movement of the latter operates the former so as to unlock the tabulation and to hold said carriage at the place determined by the set blade.

8. The tabulator as defined in claim 7, wherein said means for locking and unlocking the tabulation includes mounting means for mounting said plurality of movable tabulator stops free to move between said inactive position and said active position, said mounting means being free to move when a tabulator stop thereof, in said active position, is struck by said stop means, the rest of said means for locking and unlocking the tabulation being so partly mounted to move, and so partly mounted not to move, with said mounting means as to cause operation of said means for locking and unlocking the tabulation when said mounting means moves.

9. The tabulator as defined in claim 8, wherein said mounting means is a rod defining an axis and free to move therealong.

10. The tabulator as defined in claim 5, further including means for pivoting said tabulator rod to said plurality of positions, said plurality being four in number, for setting and clearing said blades and for carrying out the tabulation in cooperation with said first and second fixed stops and said carriage stop.

11. The tabulator as defined in claim 1, further including a plurality of tabulator stops comprised by said selector means, each tabulator stop corresponding to a respective tabulator key; and longitudinally movable rod support means for rotatably mounting said plurality of tabulator stops and for locking and unlocking the tabulation, said tabulator stops rotating about the axis of said rod support means.

* * * * *